US009291946B2

(12) United States Patent
Watanabe

(10) Patent No.: US 9,291,946 B2
(45) Date of Patent: Mar. 22, 2016

(54) DEVELOPING DEVICE HAVING OVERLAPPING SEAL MEMBERS, AND PROCESS CARTRIDGE

(71) Applicant: CANON KABUSHIKI KAISHA, Tokyo (JP)

(72) Inventor: Koichi Watanabe, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/483,391

(22) Filed: Sep. 11, 2014

(65) Prior Publication Data

US 2015/0078778 A1 Mar. 19, 2015

(30) Foreign Application Priority Data

Sep. 18, 2013 (JP) ..... 2013-192765

(51) Int. Cl.
*G03G 15/08* (2006.01)

(52) U.S. Cl.
CPC ..... *G03G 15/0898* (2013.01)

(58) Field of Classification Search
CPC ..... G03G 15/0898
USPC ..... 399/103
See application file for complete search history.

(56) References Cited

U.S. PATENT DOCUMENTS 4,943,829 A * 7/1990 Sasaki ..... G03G 15/0898 399/105
5,655,178 A * 8/1997 Ishikawa et al. ..... 399/102
6,070,027 A * 5/2000 Kawai et al. ..... 399/103
2003/0012580 A1* 1/2003 Miyabe ..... 399/103
2007/0071489 A1* 3/2007 Nakaya ..... G03G 15/0812 399/103
2007/0086805 A1* 4/2007 Matsushita et al. ..... 399/103
2009/0274481 A1* 11/2009 Xu et al. ..... 399/103
2012/0177401 A1 7/2012 Nishida (Continued)

FOREIGN PATENT DOCUMENTS

JP 04025877 A * 1/1992
JP 08-036305 A 2/1996

(Continued)

OTHER PUBLICATIONS

Abstract translation of JP 40425877.*

(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

A developing device includes a developer carrying member, a developing container, a pair of first seal members provided at end portions of the developer carrying member along a circumferential direction of the developer carrying member so as to contact the developer carrying member, and a pair of second seal members configured to seal the end portions of the developer carrying member. The second seal members are provided at overlapping positions with the first seal members with respect to a circumferential surface of the developer carrying member and an axial direction of the developer carrying member. The second seal members are mountable in a direction crossing the axial direction of the developer carrying member and into a main assembly of an image forming apparatus in a state in which the developer carrying member is mounted in the image forming apparatus.

6 Claims, 8 Drawing Sheets

(56) References Cited

U.S. PATENT DOCUMENTS

2013/0084098 A1* 4/2013 Kanazawa et al. ..... 399/103
2014/0255061 A1 9/2014 Yasumoto et al.

FOREIGN PATENT DOCUMENTS

JP 2008-129140 A 6/2008
JP 2012-159828 A 8/2012

OTHER PUBLICATIONS

U.S. Appl. No. 13/340,746, filed Jul. 25, 2014, Takeshi Yasumoto et al.
U.S. Appl. No. 14/451,640, filed Aug. 5, 2014, Dai Kanai et al.

* cited by examiner (a)

(b)

DEVELOPING DEVICE HAVING OVERLAPPING SEAL MEMBERS, AND PROCESS CARTRIDGE

FIELD OF THE INVENTION AND RELATED ART

The present invention relates to a developing device for developing an electrostatic latent image formed on an image bearing member and a process cartridge including the image bearing member and the developing device.

In an image forming apparatus, the electrostatic latent image is formed on a photosensitive drum as an image bearing member, and there is developed by the developing device with a developer, e.g., containing a toner and a carrier, so that a toner image is formed on the photosensitive drum. The developing device includes a developing sleeve for feeding such developer while carrying the developer and carries the developer by a magnetic force of a magnet provided in the developing sleeve. Here, in a developing sleeve end portion side as a magnet end portion position, the magnetic force by the magnet is lowered and therefore the developer is liable to scatter. For this reason, a structure in which leakage of the developer from the developing sleeve end portion side is suppressed by sealing the developing sleeve in the end portion side of the developing sleeve has been conventionally known (Japanese Laid-Open Patent Application (JP-A) 2012-159828 corresponding to U.S. Patent Application Publication No. US 2012/0177401).

However, in the case where the seal is disposed at the developing sleeve end portion side, when the developing sleeve is mounted in a developing container, a sealable range is 180 degrees or less. This will be described with reference to FIG. 10. A developing container 200 is provided with an opening 202, in a region opposing an unshown photosensitive drum, through which a developing sleeve 201 is capable of being freely inserted. The insertion of the developing sleeve 201 into the developing container 200 is carried out from an arrow α direction in FIG. 10. For this reason, in order to cause the developing sleeve 201 to pass through the opening 202 to reach a predetermined position in the developing container 200, a space having a range of 180 degrees with respect to a circumferential direction shown by a broken line β in FIG. 10 is needed. As a result, a seal member 203 for sealing the developing sleeve 201 in the end portion side is provided within a range γ shown by a solid black portion in FIG. 10. In this way, when a range in which the seal member for sealing the developing sleeve in the end portion side can be disposed is limited, leakage of the developer cannot be sufficiently suppressed.

SUMMARY OF THE INVENTION

A principal object of the present invention is to provide a developing device and a process cartridge which are capable of sufficiently suppressing leakage of a developer without impairing a developing sleeve mounting property in view of the above-described circumstances.

According to an aspect of the present invention, there is provided a developing device comprising: a developer carrying member for carrying and feeding a developer to a developing position, opposing an image bearing member, where an electrostatic latent image formed on the image bearing member is to be developed; a developing container for rotatably supporting the developer carrying member and for accommodating the developer to be supplied to the developer carrying member; a pair of first seal members provided at end portions of the developer carrying member along a circumferential direction of the developer carrying member so as to contact the developer carrying member in a side opposite from a side where the developer carrying member opposes the image bearing member; and a pair of second seal members provided at the end portions of the developer carrying member adjacent to the first seal members in a side which is downstream of the developing position and which is upstream of the first seal members with respect to a rotational direction of the developer carrying member, wherein the second seal members contact a surface of the developer carrying member.

According to another aspect of the present invention, there is provided a process cartridge comprising: an image bearing member for bearing an image; and the developing device described above.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
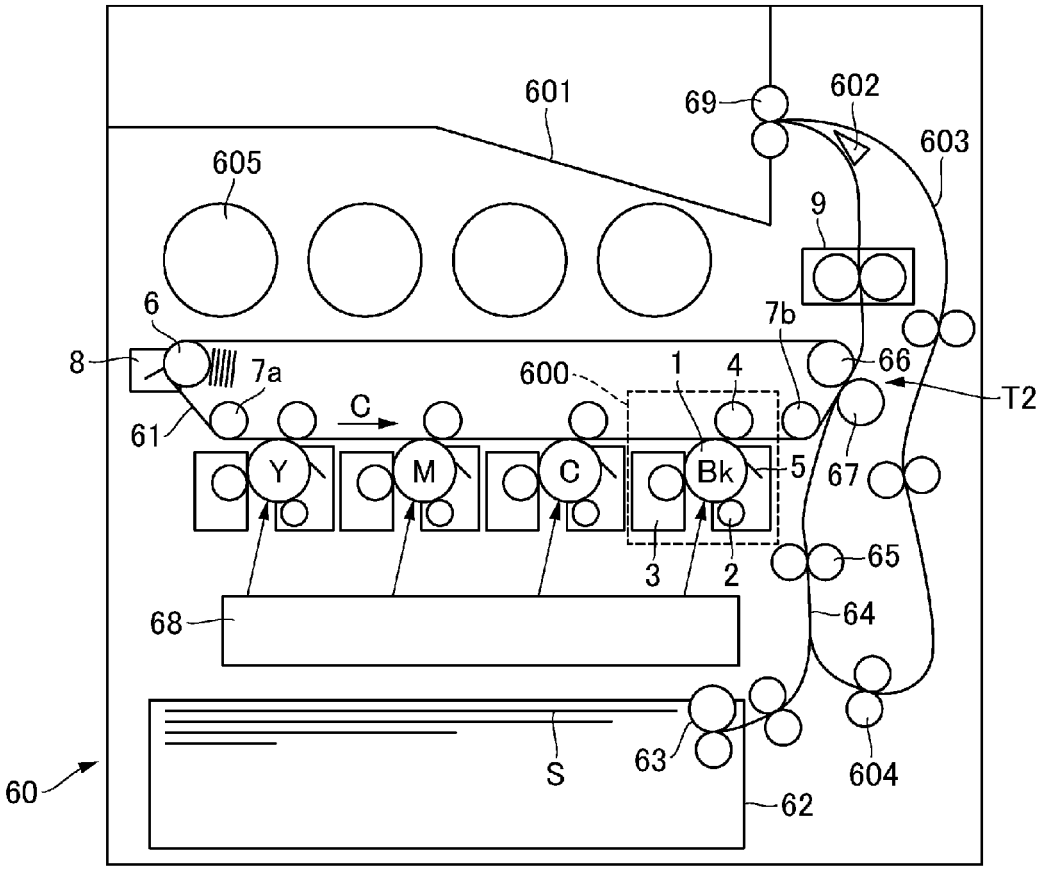
FIG. 1 is a schematic sectional view showing a structure of an image forming apparatus in an Embodiment of the present invention.

An embodiment of the present invention will be described with reference to FIGS. 1 to 9. First, a general structure of an image forming apparatus in this embodiment will be described with reference to FIG. 1. Incidentally, the image forming apparatus in this embodiment is a printer, a copying machine, a facsimile machine, a multi-function machine having a plurality of functions of these machines, and the like. A structure shown in FIG. 1 is a color image forming apparatus of an electrophotographic type.

[Image Forming Apparatus]

An image forming apparatus 60 has a structure of a so-called intermediary transfer tandem type in which image forming portions for four colors are provided opposed to an intermediary transfer belt 61 as an intermediary transfer member. The intermediary transfer tandem type is a mainstream constitution in recent years from a viewpoint of high productivity and a viewpoint that it can meet feeding of various media.

[Feeding Process of Recording Material]

A recording material S which is a sheet material such as a sheet (paper) or an OHP sheet is accommodated in a recording material storage (cassette) 62 in a stacked manner, and is fed to a feeding path 64 as a recording material feeding path by a feeding roller 63 as a feeding means by being timed to image formation. The recording material S fed by the feeding roller 63 is fed to a registration roller 65 provided in a halfway position of the feeding path 64. Then, oblique movement correction and timing correction of the recording material S are made by the registration roller 65, and thereafter the recording material S is fed to a secondary transfer portion T2. The secondary transfer portion T2 is a transfer nip formed by opposing rollers consisting of an inner secondary transfer roller 66 and an outer secondary transfer roller 67, and a toner image is attracted to the recording material S by applying a predetermined pressure and a predetermined electrostatic load bias.

[Image Forming Portion]

The feeding process of the recording material

S to the secondary transfer portion T2 is described above. An image forming process of an image sent to the secondary transfer portion T2 at the same timing will be described. The process cartridge 600 as each of the image forming portions is constituted principally by a photosensitive drum (photosensitive member) 1 as an image bearing member, a charging device 2, a developing device 3, a primary transfer device 4, a drum cleaner 5 and the like. Incidentally, the process cartridges for respective colors basically have the same constitution, and therefore. In FIG. 1, only components of the process cartridge 600 for black (Bk) are represented by reference numbers or symbols and other process cartridges will be omitted from description.

A surface of the photosensitive drum 1 to be rotationally driven is electrically charged uniformly in advance by the charging device 2, and then an electrostatic latent image is formed by an exposure device 68 driven on the basis of an image information signal. Next, the electrostatic latent image formed on the photosensitive drum 1 is subjected to development with a toner by the developing device to be visualized. That is, the developing device 3 develops the electrostatic latent image with the toner as the developer, so that a toner image is formed on the photosensitive drum 1. Thereafter, the toner image formed on the photosensitive drum 1 is primary-transferred onto the intermediary transfer belt 61 by providing a predetermined pressure and a predetermined electrostatic load bias by a primary transfer device 4. A transfer residual toner remaining on the photosensitive drum 1 in a slight amount after the transfer is collected by the drum cleaner 5, and then is subjected to a subsequent image forming process.

The image forming process described above is performed by each of the process cartridges 600 of the respective colors of yellow (Y), magenta (M), cyan (C) and black (Bk). However, the number of the colors is not limited to 4, and also the order of arrangement of these portions of the respective colors is not limited to the above order.

Next, the intermediary transfer belt 61 will be described. The intermediary transfer belt 61 is stretched by a tension roller 6, the inner secondary transfer roller 66 and follower rollers 7*a* and 7*b*, and is an endless belt to be fed and driven in an arrow C direction in FIG. 1. Here, the inner secondary transfer roller 66 also functions as a driving roller for driving the intermediary transfer belt 61. The image forming processes, for the respective colors, to be performed in parallel by the above-described process cartridges 600 of the respective colors are performed at timing when the toner images are successively superposed on the upstream color toner images primary-transferred onto the intermediary transfer belt 61. As a result, a fall-color toner image is finally formed on the intermediary transfer belt 61 and then is fed to the secondary transfer portion T2. Incidentally, a transfer residual toner passing through the secondary transfer portion T2 is collected by a transfer cleaner device 8.

[Process of Secondary Transfer and Subsequent Steps]

By the feeding process and the image forming process which are described above, respectively, timing of the recording material S and timing of the full-color toner image coincide with each other at the secondary transfer portion T2, where secondary transfer of the toner images from the intermediary transfer belt 61 onto the recording material S is effected. Thereafter, the recording material S is fed to a fixing device 9, where the toner image is melted and fixed on the recording material S by predetermined pressure and heat quantity. The thus image-fixed recording material S is subjected to selection such that the recording material S is discharged onto a discharge tray 601 as it is by normal rotation of a discharging roller 69 or is subjected to double-side image formation.

In the case where there is a need to effect the double-side image formation, after a trailing end of the recording material S is fed until it passes through a switching member 602 by the normal rotation of the discharging roller 69, by reversely rotating the discharging roller 69, a leading end and the trailing end of the recording material S are interchanged and then the recording material S is fed to a feeding path 603 for the double-side image formation. Thereafter, the recording material S is fed again to the feeding path 64 by a feeding roller 604 for re-feeding by being timed to a recording material, in a subsequent job, to be fed by the feeding roller 63. Subsequent feeding and image forming processes for the image formation on the back (second) surface are the same as those described above.

[Process Cartridge and Developing Device]

Figure 2:
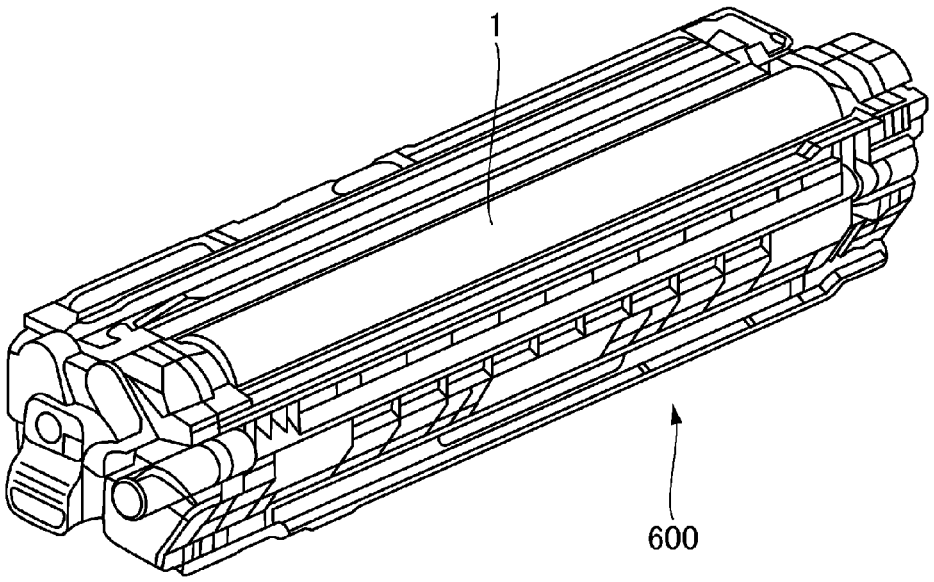
FIG. 2 is a perspective view of a process cartridge according to the Embodiment.
Figure 3:
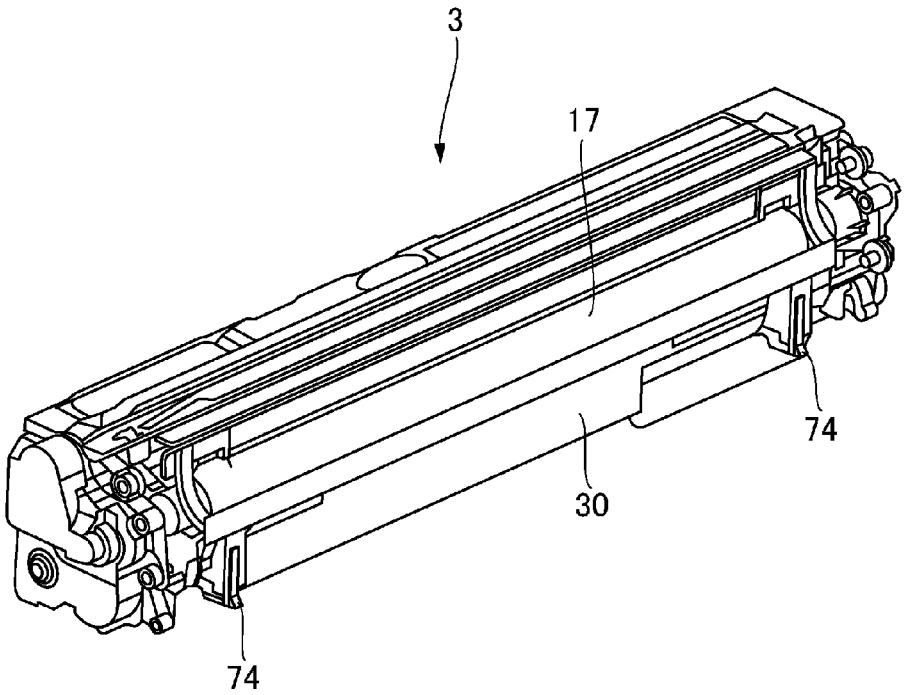
FIG. 3 is a developing device according to the Embodiment.
Figure 4:
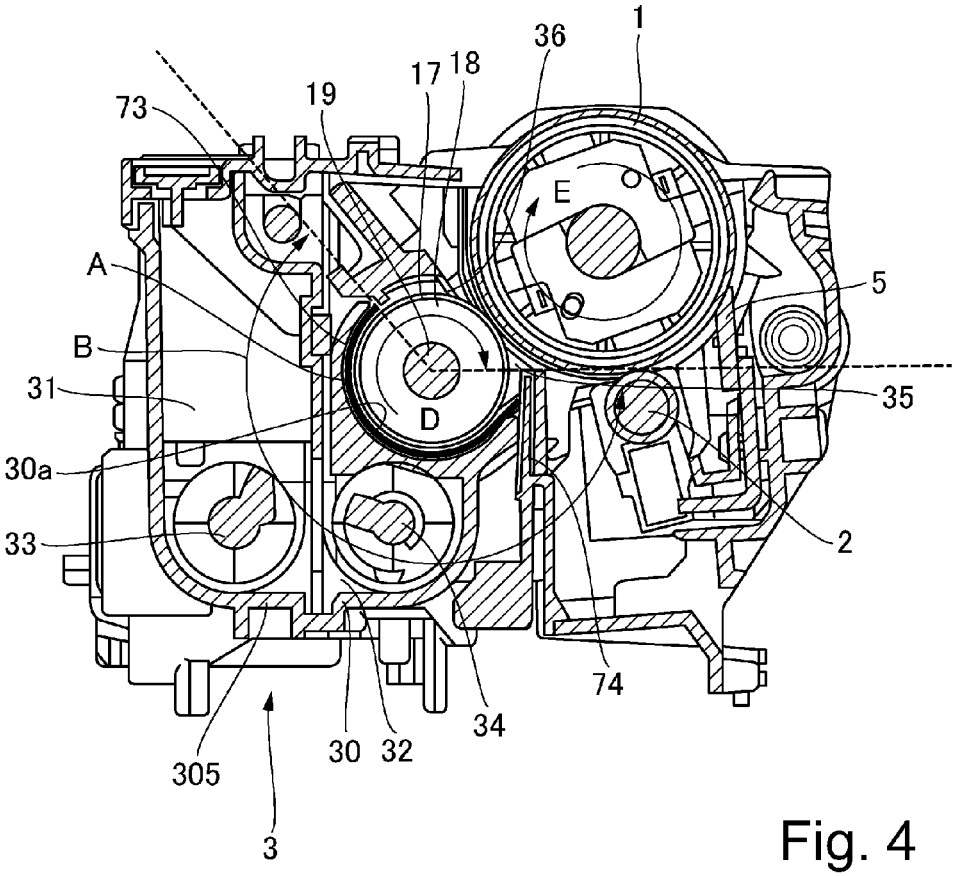
FIG. 4 is a cross-sectional view of the process cartridge according to the Embodiment.

Next, the process cartridge 600 and the developing device 3 in this embodiment will be described with reference to FIGS. 2 to 4. The process cartridge 600 is constituted as shown in FIGS. 2 and 4 and includes the developing device as shown in FIG. 3. In the developing device 3, as a developer, a two-change developer obtained by mixing a non-magnetic toner and a magnetic carrier is used. The toner for each of the colors is supplied from a toner cartridge 605 (FIG. 1) set in the image forming apparatus 60 into a developing container 30 of the developing device 3 via an unshown toner feeding path.

The developing device 3 includes the developing container 30 for accommodating the developer. In the developing container 30, a first feeding chamber 31 and a second feeding chamber 32 which are partitioned by a partition wall are provided and are connected with each other at their end portions with respect to a longitudinal direction. A first feeding screw 33 and a second feeding screw 34 are rotatably supported in the first feeding chamber 31 and the second feeding chamber 32, respectively, and are driven to circulate the toner, fed in the process cartridge 30, through the two feeding chambers. Here, the magnetic carrier is contained in advance in the developing container 30, and the toner is sufficiently stirred with the magnetic carrier during the circulation in the first feeding chamber 31 to be triboelectrically charged, so that the toner and the magnetic carrier are fed to the second feeding chamber 32.

The second feeding screw 34 in the second feeding chamber 32 is disposed opposed to a cylindrical developing sleeve 17 and feeds and supplies the toner deposited on the magnetic carrier by the triboelectric charge with the magnetic carrier. The developing sleeve 17 is rotatably supported in substantially parallel to the photosensitive drum 1 at a predetermined position in the developing container 30, and carries and feeds the developer by being rotationally driven by an unshown driving source. In the developing sleeve 17, a magnet portion 18 for carrying the developer on the developing sleeve 17 is provided along a rotational axis direction (longitudinal direction) of the developing sleeve 17. The magnet portion 18 is supported in an unrotatable manner so as to fix a magnetic pole pattern at a predetermined phase with respect to a circumferential direction in order to generate a desired magnetic field, and the developing sleeve 17 rotates around the magnet portion 18.

The thus-constituted developing sleeve 17 carries the magnetic carrier, in a chain shape on a surface thereof by a magnetic force of the magnet portion 18, on which the toner supplied from the second feeding screw 34 is deposited by triboelectric charge. Then, by rotation, the developing sleeve 17 feeds the toner and the carrier in the arrow D direction in FIG. 4. Incidentally, in this embodiment, the rotational direction D of the developing sleeve 17 is set so as to be counter-directional to the rotational direction E of the photosensitive drum 1, but may also be set so as to be the same direction as the rotational direction E of the photosensitive drum 1.

The developing container 30 is provided with an opening 35 in a region where the developing sleeve 17 opposes the photosensitive drum 1. At the opening 35, the developing sleeve 17 is formed in an insertable manner. The developing container 30 supports the developing sleeve 17 so that the developing sleeve 17 is partly exposed to the opening 35 at the predetermined position described above. A layer thickness of the developer, consisting of the toner and the carrier, carried and fed to the developing sleeve 17 as described above is regulated by a regulating blade 36 provided in the neighborhood of the opening 35, so that the developer is fed to a developing region where the developing sleeve 17 and the photosensitive drum 1 are close to and oppose each other. In the developing region, by applying a developing bias between the developing sleeve 17 and the photosensitive drum 1, the electrostatic latent image formed on the photosensitive drum 1 is developed with the developer of which layer thickness is regulated as described above.

[First Seal Member]

A first seal member 73 for sealing a part of the developing sleeve 17 in an end portion side of the developing sleeve 17 in this embodiment will be described with reference to FIGS. 4 to 6. The first seal member 73 is provided, between a part of the developing sleeve 17 and the developing container 30, in a seal range A of 180 degrees or less with respect to a circumferential direction of the developing sleeve 17 so that the developing sleeve 17 can pass through the opening 35 and is mountable at the above-described predetermined position. In this seal range A, the first seal member 73 suppresses leakage of the developer. In the case of this embodiment, the seal range A is such a range that the first seal member 73 contacts a peripheral surface of the developing sleeve 17 as shown by a solid black portion in FIG. 4. Accordingly, a length itself of the first seal member 73 may also exceed 180 degrees if insertion of the developing sleeve 17 described later is not prevented and if there is no functional problem such as interference with each member.

Figure 5:
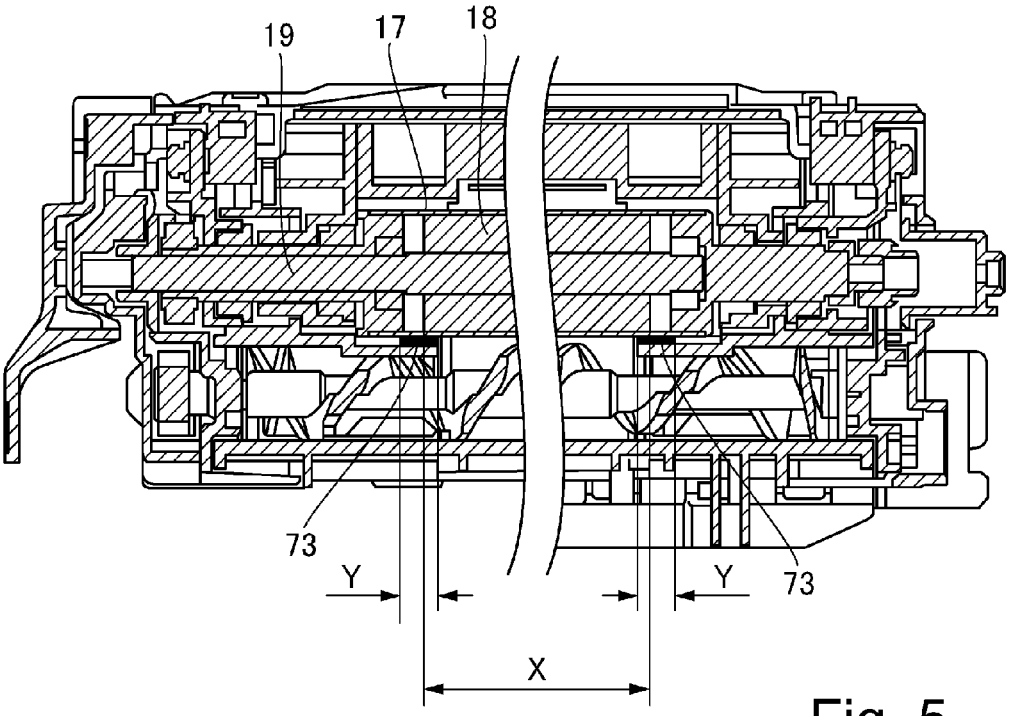
FIG. 5 is a longitudinal sectional view, showing the process cartridge by parting omitting the process cartridge, for illustrating a longitudinal position of first seal members.
Figure 6:
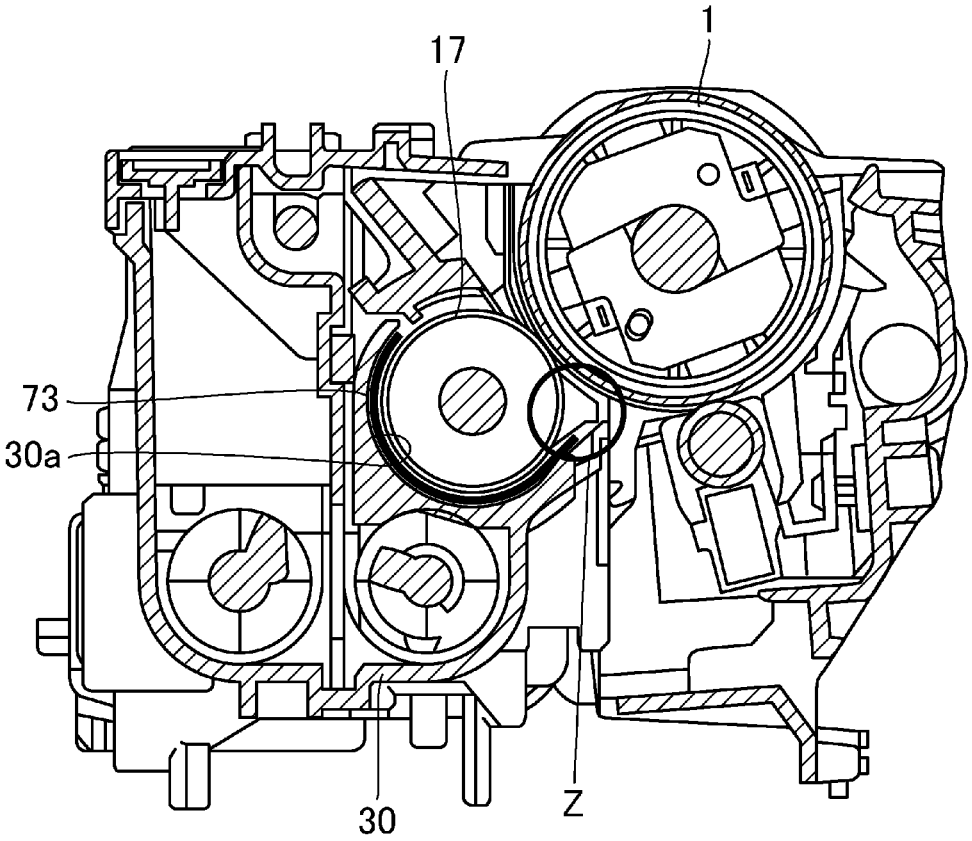
FIG. 6 is a cross-sectional view of the process cartridge provided with only the first seal member.

In this embodiment, the first seal member 73 is, as shown in FIG. 5, provided in each of end portion sides of the developing sleeve 17. Further, as shown in FIG. 4, the seal range A of each of the first seal members 73 is 180 degrees. For this reason, each of the first seal members 73 is formed with a band-like member having a length in which the first seal member 73 can cover the peripheral surface of the developing sleeve 17 in a range of 180 degrees.

The first seal member 73 is contacted to a part of the peripheral surface of the developing sleeve 17 at one surface thereof, and is fixed, at an opposite surface (the other surface) thereof, to a curved surface 30*a* of the developing container 30 opposing the part of the peripheral surface of the developing sleeve 17 by an adhesive such as a double-side tape. This curved surface 30*a* is positioned in a side opposite from the opening 35 via the developing sleeve 17, and is formed along the part of the peripheral surface of the developing sleeve 17. An interval between the curved surface 30*a* and the part of the peripheral surface of the developing sleeve 17 is substantially uniform over the circumferential direction in a range (180 degrees in this embodiment) in which the first seal member 73 contacts the peripheral surface of the developing sleeve 17.

The developing sleeve 17 has a cylindrical surface, smoothly formed, at each of end portions thereof, and includes a developer carrying portion, inside the end portions, provided with projections and recesses at a surface thereof. For this reason, the first seal member 73 slides with the part of the peripheral of the developing sleeve 17 at each of the end portions of the developing sleeve 17 at the smooth cylindrical surface by rotation of the developing sleeve 17. The first seal member 73 is constituted by a seal member which is not readily broken by friction and which has a low resilience.

The first seal member 73 is disposed at an overlapping position with each of rotational axis direction end portions of at least the magnet portion 18 with respect to a rotational axis direction (longitudinal direction, width direction or left-right direction in FIG. 4). This will be described with reference to FIG. 5. Inside the developing sleeve 17, a fixing shaft 19 is provided so as to penetrate the developing sleeve 17 along the rotational axis direction, and on which the magnet portion 18 is fixed. The developing sleeve 17 is disposed rotatably relative to this fixing shaft 19. A width direction dimension (left-right direction dimension in FIG. 5) X of the magnet portion 18 at least has a length which is not less than an image forming region where the toner image is to be formed on the photosensitive drum 1, and is shorter than a longitudinal direction dimension of the developing sleeve 17.

The first seal member 73 is disposed at an overlapping position with each of the end portions of the magnet portion 18 disposed as described above. That is, as shown in FIG. 5, within a width direction dimension Y of the first seal member 73, an associated one of the end portions of the magnet portion 18 is positioned. As described above, at the end portion of the magnet portion 18, the magnetic force is decreased, and therefore the toner is in a state in which the toner is liable to scatter relative to other portions. For this reason, a part of the developing sleeve 17 where the end portion of the magnet portion 18 decreasing in magnetic force is positioned is required to be mainly sealed. Accordingly, in this embodiment, the first seal member 73 is disposed as described above.

In the case of this embodiment, assembling of the first seal member 73 and the developing sleeve 17 with the developing container 30 is made in the following manner. First, the first seal member 73 is applied to the curved surface 30*a* of the developing container 30. Then, the developing sleeve 17 is inserted into the developing container 30 from a direction perpendicular to the rotational axis direction of the developing sleeve 17 through the opening 35, and then is supported and fixed at a predetermined position of the developing container 30 so that the peripheral surface of the developing sleeve 17 in each of the end portion sides contacts the first seal member 73. As a result, the developing sleeve 17 is sealed by the first seal member 73 in the range of 180 degrees at the peripheral surface thereof in each of the end portion sides as shown in FIG. 6.

Here, the developer carried on the developing sleeve 17 by the magnetic force of the magnet portion 18 is transferred onto the photosensitive drum 1 disposed with a certain interval with the developing sleeve 17, so that the toner image is formed. That is, in the developing region, the electrostatic latent image formed on the photosensitive drum 1 is developed with the developer carried on the developing sleeve 17. The developer in an initial stage has a large charge amount, and therefore a transfer performance of the toner image onto the photosensitive drum 1 is good. However, the charge amount is decreased with deterioration of the developer and therefore also the transfer performance is gradually lowered. Then, the toner which is not transferred from the developing sleeve 17 onto the photosensitive drum 1, i.e., the developer which is not used for development in the developing region is returned again to the developing device 3. At this time, an untransferred toner returned again to the developing device 3 after passing through the surface of the photosensitive drum 1 passes through a region Z, where the developing sleeve 17 cannot be sealed with the first seal member 73, in a downstream side of the developing region with respect to the rotational direction of the developing sleeve 17 as shown in FIG. 6. This region Z is a region, of the peripheral region of the developing sleeve 17, where the developing sleeve 17 cannot be sealed between the end portion of the first seal member 73 and the developing region by setting the seal range A of the first seal member 73 at 180 degrees or less as described above.

The toner which is not used for development in this way has a small charge amount and therefore is very liable to scatter. Further, in the neighborhood of each of the end portions, of the magnet portion 18 of the developing sleeve 17, where the magnetic force is lowered, the toner is most liable to scatter. Therefore, in such a region 8 where the developing sleeve 17 cannot be sealed, the toner is liable to scatter. Particularly, with the deterioration of the toner, an amount of toner scattering from the region Z becomes large, so that contamination of a portion outside the process cartridge 600 occurs. Accordingly, it is important that the region E is blocked in order to further improve the sealing performance.

[Second Seal Member]

In this embodiment, the region Z, which is a portion where the developing sleeve 17 cannot be sealed, generated by limiting the seal range A of the first seal member 73 as described above is blocked by a second seal member 74. That is, the second seal member 74 is disposed with respect to each of the pair of first seal members 73 disposed in the end portion sides of the developing sleeve 17. This second seal member 74 will be described with reference to FIGS. 4, 7 and 9.

The second seal member 74 can be disposed after the developing sleeve 17 is mounted in the developing container 30. The second seal member 74 is close to or contacts a pair of the developing sleeve 17 ends so as to extend the seal range A of the first seal member 73. In this embodiment, as shown in FIG. 4, the second seal member 74 is disposed so as to be close to a part of the peripheral surface of the developing sleeve 17. By disposing the second seal member 74 in this way, the leakage of the developer is suppressed by setting a region B, where a part of the developing sleeve 17 is covered, at an angle which is larger than 180 degrees in combination with the seal range A of the first seal member 73.

Figure 7:
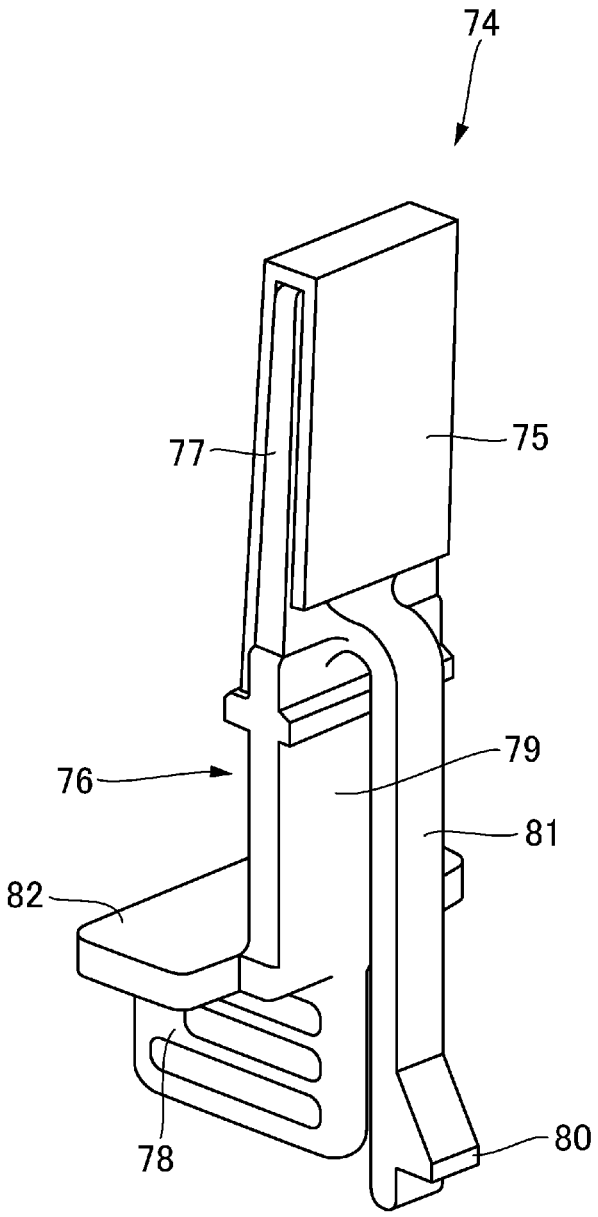
FIG. 7 is a perspective view of a second seal member in the Embodiment.

Description will be made specifically. First, the second seal member 74 is constituted so as to be detachably mountable to the developing container 30, and as shown in FIG. 7, is constituted by a seal material 75 and a seal holding member 76 on which the seal material 74 is mounted. The seal material 75 is formed in a band shape having a predetermined length, and is fixed so as to wind around a holding plate portion 77 provided at an intermediary portion or a free end portion of the seal holding member 76. For this reason, the seal material 75 is provided, at one surface thereof, with an adhesive such as a double-side tape, and is wound around the holding plate portion 77 at the one surface thereof, whereby the seal material 75 is applied, at the one surface thereof, to the holding plate portion 77 so as to cover both surfaces of the holding plate portion 77.

In this way, the seal material 75 fixed on the seal holding member 76 is close to a part of the developing sleeve 17. The seal material 75 is disposed in the neighborhood of the developing sleeve 17, and therefore it is preferable that a material which can suppress a rotational sliding resistance of the developing sleeve 17 in contact with the developing sleeve 17 and which has high breaking strength is used. For this reason, the material for the seal material 75 may preferably have a sliding property and low resilience, and specifically it is preferable that the seal material 75 is a pile material on which fibers are planted. Incidentally, the pile material may only be required to be provided at a portion, of the second seal member 74, close to or contacting at least a part of the developing sleeve 17. However, in this embodiment, the pile material is used as a whole of the seal material 75, and the adhesive such as the double-side tape is provided on a back surface where fibers are not planted, and the seal material 75 is applied to the holding plate portion 77 at the back surface.

Figure 8:
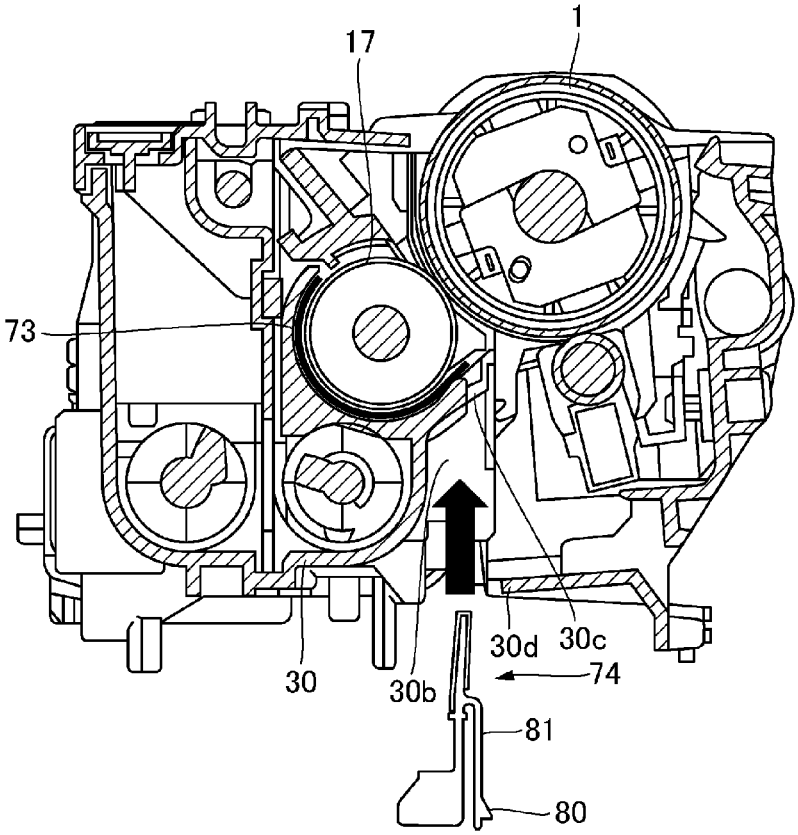
In FIG. 8, (*a*) and (*b*) are cross-sectional views, of the process cartridge, showing states of the second seal member before and after mounting, respectively.
Figure 8:
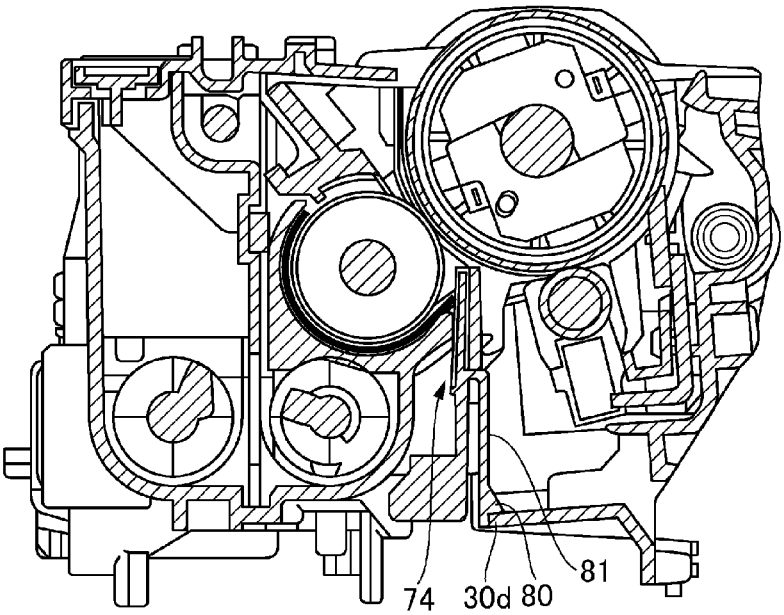

The seal holding member 76 for fixing the thus-constituted seal material 75 includes the holding plate portion 77 for fixing the seal material 75, a grip portion 78 provided at a base end portion, a connecting portion 79 for connecting the holding plate portion 77 and the grip portion 78, and a hooking portion 80. In a connecting portion 79 side the grip portion 78, a blocking plate portion 82 perpendicular to the connecting portion 79 is provided. Such a seal holding member 76 is formed by integral molding of these portions with a resin material or the like. The grip portion 78 is, as described later, a portion gripped by a user when the second seal member 74 is mounted to and dismounted from the developing container 30. The hooking portion 80 is provided at a free end portion of an extended portion 81 extended from the intermediary portion of the seal holding member 76, and is engaged with a part of the developing container 30 when the second seal member 74 is mounted in the developing container 30. The mounting of the thus-constituted second seal member 74 into the developing container 30 is carried out as shown in FIG. 8. In FIG. 8, (*a*) shows a state before the mounting of the second seal member 74, and (*b*) shows a state after the mounting of the second seal member 74. First, the second seal member 74 is inserted from a direction shown in (*a*) of FIG. 8 by an arrow into a mounting space 30*b* provided in a part of the developing sleeve 30 to which the first seal member 73 and the developing sleeve 17 are mounted. At this time, the user performs an inserting operation while gripping the grip portion 78. At a rear portion of the mounting space 30*b*, an inserting hole 30*c* through which a free end portion, of the second seal member 74, where the seal material 75 is provided is freely inserted is formed.

Then, as shown in (*b*) of FIG. 8, the second seal member 74 is inserted until the free end portion of the seal material 75 abuts against the inserting hole 30*c*, so that the hooking portion 80 is engaged with an engaging portion 30*d* provided to the developing container 30. At this time, the extended portion 81 is elastically formed, so that the hooking portion 80 passes through the engaging portion 30*d*. Thereafter, by an elastically restoring force of the extended portion 81, the hooking portion 80 engages with the engaging portion 30*d* with reliability, thus preventing the second seal member 74 from dropping off from the developing container 30. In this way, in a state in which the hooking portion 80 engages with the engaging portion 30*d*, the seal material 75 fills the gap of the inserting hole 30*c* and a part of the seal material 75 approaches a part of the developing sleeve 17. Further, in a mounted state of the second seal member 74 to the developing container 30, the free end of the seal material 75 approaches the photosensitive drum 1. As a result, the above-described region Z is covered with the second seal member 74 in the opening side.

Figure 9:
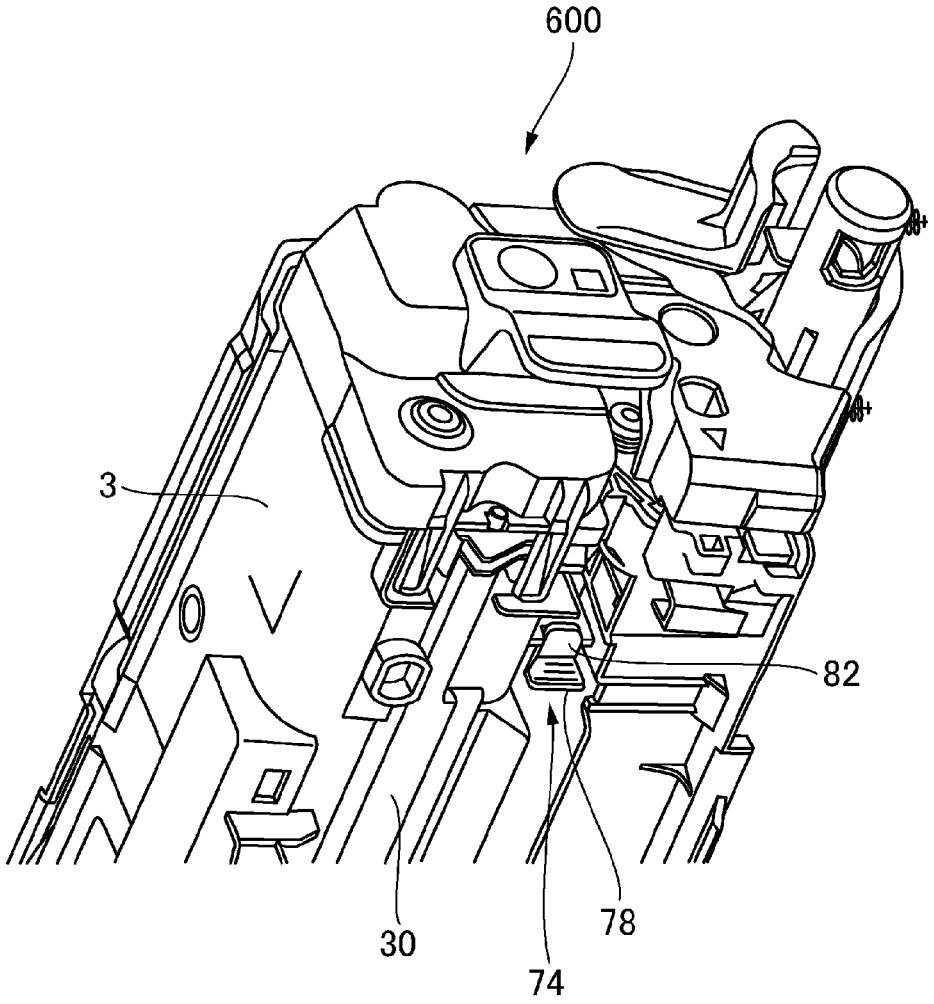
FIG. 9 is a partial perspective view showing the process cartridge in which the second seal member is mounted.
Figure 10:
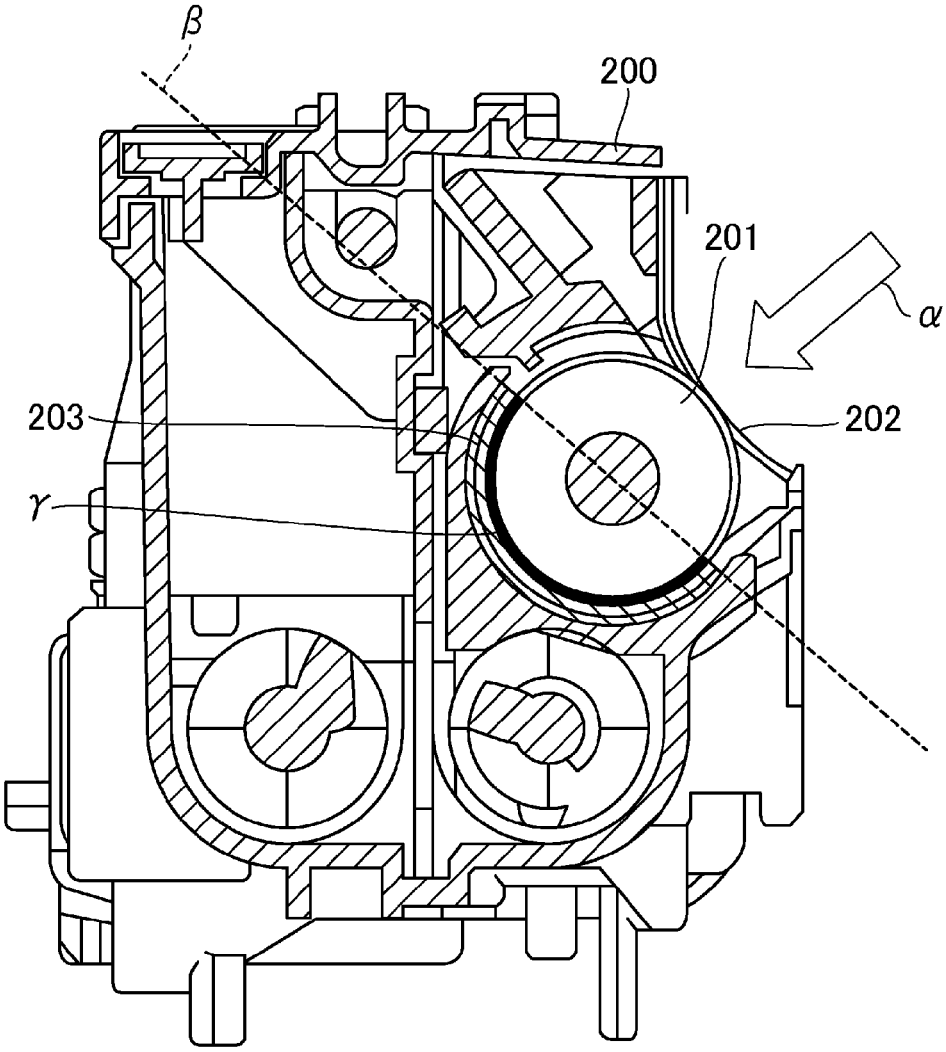
FIG. 10 is a cross-sectional view of a developing device for illustrating the reason why a seal range of a seal member is limited.

In the state in which the second seal member 74 is mounted to the developing container 30, as shown in FIG. 9, the grip portion 78 is exposed from the developing container 30. For this reason, when the engagement between the hooking portion 80 and the engaging portion 30*d* is eliminated, the second seal member 74 can be disconnected from the developing container 30 while gripping the grip portion 78. The inserting hole 30*c* is covered with a blocking plate portion 82 in the opening side, so that inclusion of a foreign matter in the inserting hole 30*c* is suppressed.

In the state in which the second seal member 74 is mounted in the developing container 30 in this way, a part of the seal material 75 contacts the end portion of the first seal member 73. For this reason, in this embodiment, the second seal member 74 is disposed at an overlapping position with at least the first seal member 73. That is, at the mounting position of the second seal member 74, unless the second seal member 74 is connected with the first seal member 73 with reliability, generation of toner scattering cannot be suppressed sufficiently. For this reason, with respect to the position of the first seal member 73 disposed in each of the end sides of the developing sleeve 17, the second seal member 74 is disposed at an overlapping position between ranges of width direction dimensions of the first and second seal members 73 and 74. In a preferred example, the second seal member 74 is disposed so as to contact an entire end portion of the first seal member 73 with respect to the width direction.

In the case of the thus-constituted embodiment, the second seal member 74 disposed so that the region B in which the part of the developing sleeve 17 is covered in combination with the seal range A of the first seal member 73 is larger than 180 degrees by extending the seal range A is provided. For this reason, leakage of the developer can be sufficiently suppressed. That is, in order to mount the developing sleeve 17, the seal range A of the first seal member 73 is limited to 180 degrees or less, and therefore a sealing effect by the first seal member 73 is not sufficient. For this reason, in this embodiment, the region which cannot be sealed by the first seal member 73, i.e., the region Z in this embodiment is covered with the second seal member 74, whereby an effect against the toner scattering can be further enhanced.

Further, the second seal member 74 can be disposed after the developing sleeve 17 is mounted in the developing container 30. That is, the second seal member 74 can be mounted, after the first seal member 73 and the developing sleeve 17 are mounted in the developing container 30, so as to cover the region Z through the inserting hole 30*c* as described above. For this reason, even when the region in which the part of the developing sleeve 17 is covered with the second seal member 74 becomes larger than 180 degrees, a mounting property of the developing sleeve 17 is not impaired.

Other Embodiments

In the above-described Embodiment, the first seal member 73 is the low resilient seal material to be contacted to the peripheral surface of the developing sleeve 17, but the first seal member 73 may also have other seal constitutions such as a magnetic seal. In the case where the first seal member 73 is the magnetic seal, a magnetic sheet is fixed on the curved surface 30*a* spaced from the peripheral surface of the developing sleeve 17 by a predetermined interval. Thus, the magnetic seal is formed between the magnetic sheet and the peripheral surface of the developing sleeve 17. In this case, the seal range A is a range in which the magnetic seal is formed in this way.

According to the present invention, the second seal member disposed so that the region in which the part of the developing sleeve is covered with the second seal member in combination with the seal range of the first seal member by extending the seal range of the first seal member is larger than 180 degrees is provided, and therefore leakage of the developer can be suppressed sufficiently. Further, the second seal member can be disposed after the developing sleeve is mounted in the developing container, and therefore even when the region in which the part of the developing sleeve is covered with the second seal member is larger than 180 degrees, the mounting property of the developing sleeve is not impaired.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 192765/2013 filed Sep. 18, 2013, which is hereby incorporated by reference.

What is claimed is:

1. A developing device comprising:

a developer carrying member configured to carry and feed a developer to a developing position;

a developing container configured to rotatably support said developer carrying member and to accommodate the developer to be supplied to said developer carrying member;

a first seal member provided at one end portion of said developer carrying member along a circumferential direction of said developer carrying member so as to contact said developer carrying member, wherein a first region sealed by said first seal member ranges 180 degrees or less with respect to the circumferential direction of said developer carrying member;

a second seal member, provided at the one end portion of said developer carrying member, configured to seal the one end portion of said developer carrying member, wherein said second seal member is provided at an overlapping position with said first seal member with respect to a circumferential surface of said developer carrying member and an axial direction of said developer carrying member, wherein a seal region which is a sum of the first region and a second region sealed by said second seal member ranges more than 180 degrees with respect to the circumferential direction of said developer carrying member; and a supporting member, provided detachably mountable to said developing container, configured to support said second seal member, said supporting member includes a plate-like extended portion provided so that a surface thereof opposes the circumferential surface of said developer carrying member, wherein said second seal member is attached to said plate-like extended portion, and wherein said supporting member is provided detachably mountable to said developing container in a direction in which the plate-like extended portion is extended.

2. A developing device according to claim 1, wherein said developer carrying member is detachably mountable to a mounting position of said developing container with respect to a normal direction to said developer carrying member.

3. A developing device according to claim 1, wherein said developer carrying member includes a magnet portion, provided therein along a rotational axis direction of said developer carrying member, for carrying the developer on said developer carrying member by a magnetic force, and wherein each of said first seal members is disposed at a position where said first seal member overlaps with at least a rotational axis direction end portion of the magnet portion with respect to the rotational axis direction of said developer carrying member.

4. A developing device according to claim 1, wherein said supporting member includes a locking portion configured to be locked with said developing container, and is detachably mountable to said developing container.

5. A developing device according to claim 1, wherein said second seal member is constituted by a pile material, with at least a portion thereof contacting said developer carrying member.

6. A process cartridge comprising:

an image bearing member for bearing an image; and a developing device according to claim 1.

* * * * *